United States Patent [19]

Jenkins et al.

[11] Patent Number: 4,465,489

[45] Date of Patent: Aug. 14, 1984

[54] DECORATING METAL CONTAINERS

[75] Inventors: Leonard A. Jenkins, Kirtlington; Terence A. Turner, Frilford Heath, both of England

[73] Assignee: Metal Box PlC, Reading, England

[21] Appl. No.: 397,981

[22] Filed: Jul. 14, 1982

[30] Foreign Application Priority Data

Jul. 14, 1981 [GB] United Kingdom ..... 8121726

[51] Int. Cl.[3] ..... B41F 17/20; B44C 1/16; B41M 1/28

[52] U.S. Cl. ..... 8/471; 8/522; 427/287

[58] Field of Search ..... 8/471, 522

[56] References Cited

U.S. PATENT DOCUMENTS 4,323,601 4/1982 McMillin et al. ..... 8/471

4,352,721 10/1982 Park et al. ..... 8/471

*Primary Examiner*—A. Lionel Clingman

*Attorney, Agent, or Firm*—Diller, Ramik & Wight

[57] ABSTRACT

Metal containers, such as cans, are printed when empty by means of dye diffusion transfer, the dyes being first printed on to a paper web which is cut into individual carriers. Each carrier is secured, somewhat in the manner of a label, to a container by a water-soluble adhesive so that, upon being heated to effect dye transfer, the carrier comes into intimate contact with a suitably receptive coating, pre-applied to the container, solely by virtue of its own shrinkage. The carrier and adhesive are subsequently removed by water spray.

11 Claims, 5 Drawing Figures

DECORATING METAL CONTAINERS

This invention relates to methods of decorating metal containers by dye diffusion transfer, that is to say by a method in which, in respect of a succession of metal containers, a flexible carrier, printed with indicia in sublimable dyestuff, is applied over a coating receptive to such dyestuff on a surface of the container and the carrier is held in intimate contact with the coating whilst the container is heated so that at least some of the dyestuff migrates by sublimation into the coating before the carrier is removed from the container.

In this specification, the term "decoration" means the application of indicia, and "indicia" means any or all of the possible markings (whether visible to the naked eye or not) which may be applied to a substrate by printing, for example decorative patterns, areas of colour, pictures or diagrams, trade marks, instructions, lists of ingredients, statutory legends or other written matter, sales codes, factory codes, and so on. The term "container" includes an empty container body.

Dye diffusion transfer techniques have long been used in the printing of textile fabrics, which represent the field in which such techniques find their widest application, particularly in respect of synthetic fibre products which include dresses, skirts, household fabrics such as curtain or upholstery materials, and for the personalisation of teeshirts and sports wear.

Decoration by dye diffusion transfer is also increasingly used for non-textile products to which a suitable coating is first applied. Thus, for example, household products such as hob covers, saucepans, and jackets for toasters and other appliances have been successfully decorated in this way. The materials that can be given a suitable receptive coating and then decorated by dye diffusion transfer are not confined to metals, but can for example include wood or wood products such as chipboard. Dye diffusion transfer can also be used for direct application to certain ceramics after having first applied a suitable receptive coating.

Whilst some of the above-mentioned products are mass produced in the sense that large quantities of the product may be made in the course of a year, these quantities are not of the same order of magnitude as those in which many kinds of common packaging container are made. For example, the so-called open-top can in its various forms as used for beer, other beverages or food products is made at a rate which may reach hundreds of millions of cans in the course of a year from a single production line.

Modern production equipment may indeed operate at the rate of ten or more cans per second, and it follows that if the line has to be stopped for any reason the cost is correspondingly great. Thus it is highly undesirable to stop a can production line except, for example, at the end of a shift or in an emergency.

Metal open-top cans have hitherto usually been decorated in one of two ways. The first way is to attach a paper label around the can by means of a pick-up or hot melt adhesive. The second method, which has become common in the case of so-called two-piece cans (i.e. those having a one-piece can body made by processes involving deep drawing) for beer and other beverages, is to print the decoration directly on to the can itself. Certain other kinds of metal container such as paint cans, metal aerosol cans, fancy boxes and other boxes are usually made by fabrication from sheet, the sheet metal being pe-printed so that it is not the container itself that is subjected to a decoration process.

Paper labels have the advantage that a large number of cans can be produced in uninterrupted succession and then, if necessary, divided up into small batches, each batch being labelled differently from the others according to the requirements of different canners or to identify different products of a single canner. Labels do however have certain disadvantages, such as the fact that the label is susceptible to damage. Paper labels are also somewhat unsightly, and the advent of improved food cans in two-piece form, made by the so-called draw/redraw process, emphasises this as a label tends to detract from its appearance and therefore its appeal to the eventual retail buyer. Perhaps a more significant disadvantage, however, is the fact that a high proportion of canned products are foodstuffs (including beverages) which often/frequently require to be sterilised or pasteurised after the can has been filled and closed. A paper label, if applied, is normally applied after the sterisilation or pasteurisation process to prevent damage to the label. Thus if paper labels are to be used they must be applied by the canner and not by the can manufacturer.

Other disadvantages of paper labels include the fact that they are easily torn; they are susceptible to damage if the labelled cans (or the labels themselves when in store) are subjected to a damp atmosphere; and they can become detached from the can due to the effects of moisture or dust, thereby rendering use of the contents of the can unsafe, since there is then no sure way of establishing the age of the contents, and, in some cases, of establishing their exact composition and therefore of knowing under what conditions they should not be used.

In practice hitherto, paper labelling has commonly been carried out by the canner rather than the canmaker. To this end the canner must not only carry stocks of printed labels and adhesive, but must also have labelling equipment which is capable of applying labels at a speed at least as high as that at which the filling equipment operates. When using labels as the indicia-carrying element of containers, on the other hand, a canner who produces several products requiring several different label designs does not need to hold superfluous stock of empty can bodies, since his stock need only comprise sufficient to satisfy his total expected needs, instead of being required to satisfy the expected needs in respect of each and every one of the products as would be the case if he held stocks of pre-printed cans. In this latter case the stocks tend to be more than adequate because, in order to be economic, existing types of machine for printing direct on to the cans must normally be operated for long periods at a time; the result of this is that the printed cans may have to be stored for a considerable time under the necessary controlled atmospheric conditions which are themselves a source of additional cost besides the cost of the actual space which they occupy.

Thus a canmaker may find it more economic to store the minimum number of empty, uncoated and unprinted cans, and therein lies part of the attraction of applying his own decoration. On the other hand, this attraction is largely nullified by the need to provide proper protection for these cans during storage.

Paper labels have in fact been commonly used on three-piece food cans but not on the beer and beverage cans which now form an increasingly significant proportion of the open-top cans produced. This is due partly to the fact that cans can be filled with liquid at substantially higher speeds than with solid products, such as food. Paper labelling, if used, is carried out by the canner, who must not only carry stocks of printed labels and adhesive, but also has to have labelling equipment which is capable of applying labels at a speed at least as high as that at which the filling equipment operates. Thus for high-speed filling operations, it is also necessary to provide either expensive high-speed labelling equipment or several lower-speed labelling machines serving one filling line. In either case, from the canner's point of view this represents a significant outlay in terms of capital cost, occupation of factory space, and maintenance and labour costs.

For all these and other reasons it is desirable that decoration should be carried out by the can manufacturer rather than by the canner. It will also be clear from the foregoing that decoration should preferably be applied by printing on the can itself rather than by use of paper labels. However, unless the cans are of the built-up or three-piece kind made from pre-printed sheet, the manufacturer is then faced with the problem of how economically to provide relatively small batches of cans in which each batch carries different decoration from the others.

There are available high-speed decorating machines suitable for decorating the bodies of two-piece cans by a dry offset technique using a common blanket impression. Such machines do however represent a considerable capital investment and, since they are high-speed machines, any time spent in an inoperative state in order to change the impression is correspondingly expensive. They are thus not an attractive proposition for short runs from the economic point of view. Other decorating machines, operating at lower speeds and being accordingly (in theory) potentially less unattractive for "short-run" operation, are available. These employ various printing techniques. Nevertheless, they still require considerable capital investment and have to be stopped for the purpose of changing the decoration between one batch of cans and the next.

As far as printing directly on to the metal surface, or on to a suitable coating on the metal surface, of a can body is concerned, most known printing machines commonly in use suffer from another very serious disadvantage in practice. This is that the quality of the printing is very noticeably inferior to that obtainable by printing on a flat substrate such as paper or flat metal sheet. Thus there is considerable scope for introduction of a process which will enable cans to be printed to a higher standard of technical quality than is at present commonly achieved.

Use of a dye transfer printing technique, as one alternative to the conventional methods of printing on to the surface of a can body in order to improve the quality of the resulting print, has been the subject of a proposed system. In the proposal concerned, a succession of thin metal container bodies is passed in end-to-end relationship at high speed through a tubular structure, together with a continuous web of pre-printed transfer paper which is presented to the can bodies by a forming element whereby the web is wrapped around the can bodies with its side edges extending longitudinally of them. In this condition, can bodies and web are heated as they are passed along the tubular structure, so causing transfer of the dyes, with which the web is printed, into a suitable coating on the can bodies. On emergence from the tubular structure, the web is allowed to unwrap and fall away.

The above proposal is suitable for high-speed printing of large numbers of can bodies all of which are to bear identical indicia. It is not suitable where relatively small batches of can bodies are to receive different indicia so as to satisfy "short-run" requirements, unless either the machinery is to be stopped to change reels of the web (thereby suffering the disadvantages already discussed), or the web is pre-printed with a succession of different designs, which would itself pose a number of additional problems.

There remains a requirement for a method of high-quality printing that can be applied direct on to the surface of a metal can and which is capable of high-speed operation, but which will also enable short runs of different decorative designs to be applied at short notice to relatively small batches of cans, without the need to stop production so as to effect change-over from one decorative design to another, and without requiring the use of highly specialised equipment that may be expensive to purchase or to maintain.

According to the invention, in a first aspect, a method of decorating metal containers includes, in respect of each of a succession of such containers, the steps of:

applying a flexible carrier, printed with indicia in sublimable dyestuff, over a coating receptive to such dyestuff on a surface of the container, by means of an adhesive such as to be removable without damage to the coating:

heating the container whilst the carrier is adhered to it, at such a temperature and for such a time that the carrier shrinks into intimate contact with the coating and a substantial proportion of the dyestuff sublimes so as to transfer the indicia into the coating;

allowing the container to cool; and stripping the carrier and adhesive from the container.

Preferably, a separate carrier, in the form of a label, is applied to each successive container.

The use of a suitable adhesive to attach the carrier to each container provides a simple way of ensuring the necessary intimate contact between the carrier and the coating on the container surface, without the need to provide external mechanical means (which may be complicated or unreliable or both, especially in high-speed operation) for this purpose. In this connection it will be realised that in, for example, an arrangement such as that mentioned above in which a continuous carrier is wrapped around the can body and held in that condition whilst passing through a heated tubular structure, means must be provided for ensuring that the edges of the carrier do not move apart due to shrinkage during the dye transfer process. The tubular structure can act as a former for this purpose; but problems may then arise due to mechanical forces acting externally on the carrier whilst in addition the tubular structure will only be suitable for a single size of can body, thus reducing still further the versatility of a system already restricted in scope by its unsuitability, mentioned above, for "short-run" operation.

It will, furthermore, be appreciated from the foregoing that an important consequence of the use of an adhesive to apply the carrier to each container body is that the required intimate contact between carrier and body is achieved by converting into a useful feature what may otherwise be a disadvantage, viz. the fact that the carrier shrinks due to loss of moisture as a result of being heated to effect the dye transfer process. This results in considerably improved contact between carrier and container, as compared with previously-proposed arrangements where contact relies on the external application of pressure whilst heating and dye transfer take place.

If each container is decorated, in accordance with the preferred feature of this invention, using an individual carrier for each container, it will be appreciated that "short-run" operation becomes readily possible and that by suitable selection of a batch of such "labels" (which can be pre-printed and stored in a much smaller space than printed can bodies), the can manufacturer may produce relatively small batches of printed can bodies at extremely short notice. This in turn means that the canner can make considerable economies in the storage of empty containers.

A further advantage lies in the fact that the method of the invention, by using an individual carrier for each container, enables containers to be printed in a series of designs if required; for example one container may carry a picture showing one scene and the next container a picture showing another scene. This may readily be achieved, for example, by printing a multiplicity of carriers with one picture, a further set with the other picture, and then collating them into the required order before they are fed to the machine in which they are applied to the containers.

Yet another, and very important, advantage of the invention is that, not only is the quality of the decoration on the container able to be improved as compared with that currently found on most containers which have been printed by direct application using conventional container-printing equipment, but the number of colours that may be economically used is also increased. This is because the carriers are printed using conventional techniques for printing on paper, the final decoration on the container being limited only by the fact that all dyes are transparent, that there are no white dyes and that certain colours (for example metallic gold) cannot readily be transferred by the dye diffusion transfer techniques. The lack of white dyes may however be overcome by providing on the container a white base coat in conventional manner, before the container is decorated by the method of the invention.

Although the use of an individual carrier for each container is preferred because of the "flexibility" of the system thereby achieved, it is nevertheless possible, within the scope of the invention, to use a continuous carrier drawn from a coil and pre-printed with the indicia for a large number of containers. In this case the containers may be offered to the carrier in "line-ahead" formation in known manner, the carrier having the adhesive applied to its edges before being introduced to the containers.

Where individual carriers are used, however, the adhesive and carriers are preferably applied by an automatic container-labelling machine capable of operating at high speeds. Such a machine may be basically of a conventional kind, generally similar to labelling machines more usually employed by a canner for applying labels to filled cans as an alternative to printing the decoration directly on to the can. However, in the performance of the present invention the container bodies are empty and are typically of extremely thin-walled construction and therefore rather flexible. Accordingly the apparatus for applying carriers to the container bodies in preferably adapted to apply the mimimum force to each body necessary to hold and convey it and to apply the label to it. To this end, each container body may for example be received on a rotating support, for rotating the body about its own axis, with a corresponding rotating member engaging the top end of the body lightly so as to steady it during application of the carrier. The latter may be presented to the body by vacuum carrier-holding means in such a way that a portion of the carrier comes into contact with adhesive previously applied to the body and is thus drawn from the carrier-holding means and into rotation with the container body, being very gently wiped into circumferential contact with the body by soft wiping means. The latter may for example comprise one or more endless moving belts presenting towards the container body a surface of soft sponge rubber or foamed plastics material. The adhesive may be applied in the form of a spray, or a jet or jets, propelled by compressed air, or under pressure generated by a head in the supply of the adhesive itself. For this purpose an adhesive applicator may be provided which has a nozzle or a series of nozzles for directing a spray or jets of adhesive at the container body immediately prior to the application of the carrier to the latter. Alternatively, the traditional 'wipe-style' of adhesive application may be employed.

The adhesive must of course be of a kind through which the dyes can migrate with no difficulty, and must also be such as to be readily removable when the carrier is stripped from the container body. To this end, the adhesive is preferably of a water-soluble pick-up type, for example a Dextrine Gum (Trade Mark) adhesive. Such as type No. SW1934 which is a food quality yellow potato dextrine solution (the traditional description for this class of dextrines is farina). All solution ingredients are permitted by the U.S. Food and Drug Administration Ref. 21. CFR. 175.105. Solution Properties—solids 60 percent, pH 2–3, viscosity 16000 CPS (Brookfield 25 degrees C). The hot-melt type of pick-up adhesive conventionally used for applying labels to containers is not preferred, since it is not so easily removed as is a water-soluble adhesive, particularly since the bond between label and container, effected by a hot-melt adhesive, tends to be strengthened by the application of heat. A hot-melt adhesive may also tend to damage the coating on the container body.

As an alternative to a water-soluble adhesive, a tacky contact-type adhesive, of the kind that does not form a bond with the substrate, may be used, provided it is not such as to damage the coating on the container, and provided also it can readily be rolled off the container by gentle friction, even after having been heated.

Whether the carrier is in the form of individual carriers or a continuous carrier, the preferred method of applying the heat required to effect dye transfer is by hot air, rather than by the use of induction heating or heated platens as have been proposed in the past. To this end, the containers, at least in the case where individual carriers are employed, with the carrier or carriers adhered to them, are preferably passed in succession through a hot-air oven which, again, may typically be of an essentially conventional kind, such as a mat conveyor oven similar to those used for stoving internal can lacquers. This enables advantage to be taken of heating in a mass-conveyor mode, which, in turn, permits more efficient use of factory space and ensures even heating of each carrier. Typical heating conditions comprise a temperature in the range 180° C. to 220° C. applied for 30 seconds; however, it will be appreciated that both temperature and time may be varied to suit the requirements of any particular production line.

After being heated to effect dye transfer, the carriers are stripped from the containers, preferably by application of a water spray, with or without the assistance of friction. For this purpose a simple washing device is provided whereby the containers are suspended from the neck or otherwise suitably supported whilst being carried through a spray or series of sprays of water which dissolves the adhesive, and which may also wash the container clean and ready for filling with a product. Frictional assistance to the stripping operation, if provided, may for example be effected by passing the containers in contact with flexible belts, for example of rubber or textile fabric, whilst they are being subjected to the action of the water spray. If the adhesive is not of a water-soluble kind, removal of the carriers may be carried out entirely by friction, viz. by flexible belts of rubber or the like rubbing the carrier from the container and "rolling" the adhesive off the coating on the latter.

The coating on each container comprises a suitably receptive surface in the form of at least one layer of a non-linear, cross-linked polyester or a non-linear, cross-linked thermosetting acrylic resin having a substantial number of reactive groups per molecule. Examples of suitable coating materials are those of the epoxy polyester, polyester, polyester epoxy, alkyd, alkyd-melamine, acrylic, acrylated, and acrylated acrylic types. The coating, or at least one layer thereof, may be pigmented in any suitable colour, for example white (in order to provide a white base coat as mentioned earlier herein). Where a pigmented layer is provided, there is preferably a second, translucent, layer of coating material over the pigmented layer.

The sublimable dyestuffs for printing on to the carriers, and the coating materials for the containers, are so chosen that their reactive groups are mutually reactive in such a way as to effect chemical bonding between the dyestuff and the coating. Subject to this requirement, the sublimable dyestuffs preferably comprise at least one anthraquinone or quinoline dyestuff modified by addition or substitution of at least one substituted reactive group per molecule.

A method according to the invention, and embodiments of apparatus for performing such method, will now be described, by way of example only, with reference to the drawings hereof, in which.

Figure 1:
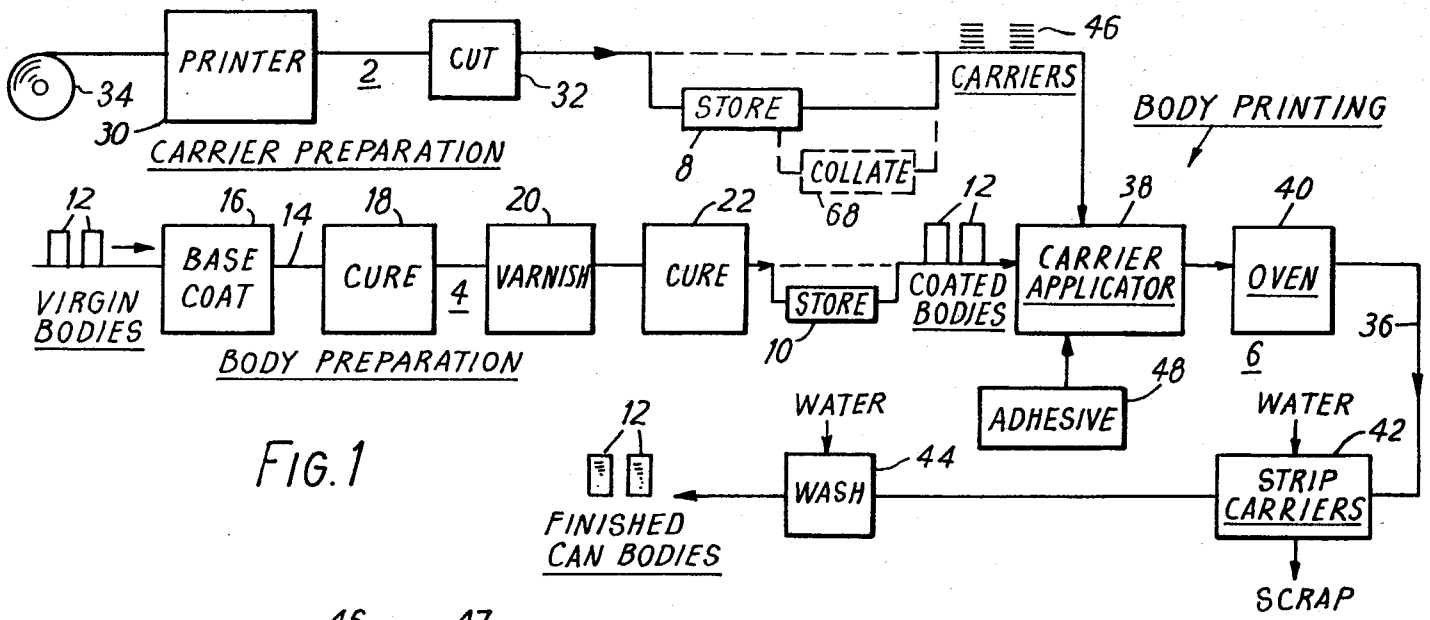
FIG. 1 is a layout or flow diagram illustrating principal steps in the method when applied to the decoration of a succession of metal cans.

Referring firstly to FIG. 1, this illustrates in diagrammatic form one possible form or layout for a printing line for the high-speed printing of metal can bodies by a dye diffusion transfer method according to the invention. The line consists essentially of three sections, viz. a can-body preparation section 4, a carrier-preparation section 2, and a can body printing section 6. Either or both of the first two of these sections, 2 and 4, lead to the body printing section 6 either directly via suitable conveyors, as will be seen, or via a respective buffer store 8 or 10.

In the body preparation section 4 of the line, can bodies 12 in a virgin stage, i.e. clean, uncoated bodies of bare metal, are carried by a first conveyor, indicated at 14, successively through conventional apparatus indicated at 16, 18, 20 and 22. In the stage 16, an organic base coat layer 24 is applied over the outside of the sidewall 26 (FIG. 2(*a*)) of each successive can body 12. The base coat is cured in the stage 18, after which a layer of an organic varnish, 28 in FIG. 2(*a*), is applied in the stage 20 so as to cover the base coat 24, the varnish being cured in the final stage 22. The can bodies 12, thus coated, are removed to the buffer store 10 to await printing as and when required. The base coat 24 in this example contains a white pigment, but is in all other respects of the same composition as the varnish layer 28, the latter being translucent. The composition may be any of those already listed as suitable earlier in this Description.

In the carrier preparation section 2, suitable paper which may be coated with a binder is printed with sublimable dyestuffs, but, by generally conventional means, in a carrier printer 30, to produce a continuous carrier of paper printed with a multiplicity of images each of which comprises the indicito be subsequently printed on a can body 12. The dyestuffs are so chosen that when heated so as to vaporise by sublimation, the varnish and base coat applied to the can bodies will be receptive to the dye vapour so as to enable dye diffusion transfer to be effected. After printing, the carrier is cut by a cutter 32 into individual carriers, each bearing one of the said images, and the carriers are stacked and transferred to the buffer store 8 to await use, as and when required in the manner hereinafter to be described.

The principal components of the body printing section 6 comprise a main can body conveyor, diagrammatically indicated at 36, which carries the coated can bodies 12 through the various stages of the process carried out in this section. These are performed, in succession, by a carrier applicator 38, a heating oven 40, a carrier stripper 42, and a can body washer 44. The carrier applicator 38 receives the individual carriers (indicated at 46) from the buffer store 8, and has an adhesive applicator 48 which applies to each successive container body a small quantity of an adhesive which is such as to stick the carrier to a coated can body 12 and to be removable therefrom without damaging the coating 24, 28 (FIG. 2(*a*)) of the can body.

Each can body 12 in this example consists of a one-piece tinplate or aluminium vessel made by drawing from a flat-blank with subsequent ironing of the side wall 26 in conventional manner, so that the latter is very thin and very flexible. To complete the virgin can body, a neck and flange (50, FIG. 3) are formed about its open end. The carrier applicator 38 comprises a conventional labelling machine such as is normally used for applying paper labels to filled cans, but is adapted to apply to each can body 12 considerably less force than is usual in such conventional machines, whereby to avoid undue flexing or possible damage to the can bodies. To this end, the carrier applicator 38 includes drive belts having a soft, spongy surface, of sponge rubber or foamed plastics material, for engaging the can bodies. In addition, the adhesive applicator 48 is in the form of a tube having a series of jet nozzles spaced along its length, the tube being arranged parallel to the axis of a can body held in the carrier applicator (and being connected to a supply of liquid adhesive and to a source of air pressure, so as to direct a series of parallel jets of adhesive under pressure on to the outer surface of the coated can body sidewall immediately prior to the application of the individual carrier 46 thereto.

The body printing oven 40 is in this example of a conventional mat-conveyor type in which the can bodies are heated by hot air whilst being passed rapidly through the oven.

In operation, can bodies 12 retrieved from the buffer store 10 are loaded on to the main conveyor 36 which conveys them one after another to the carrier applicator 38, in which adhesive is applied to the body as already described and one of the carriers 46 is then wrapped around the body so as to be adhered to it by the adhesive. It is then conveyed to the oven 40 in which it is heated for 30 seconds at a temperature of 180° C. (for example).

Figure 2B:
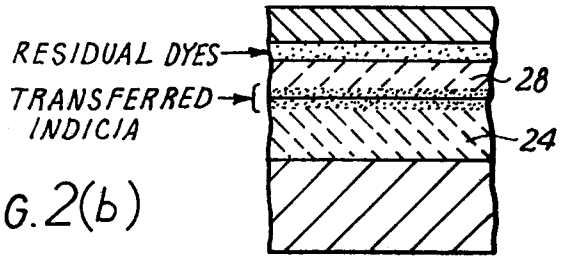
FIG. 2 shows a diagrammatic, greatly-enlarged section through a portion of a side wall of a metal can having a coating thereon and a carrier applied over the coating, FIG. 2(*a*) showing such a section immediately prior to transfer of dyes from the carrier to the coating by sublimation, and FIG. 2(*b*) showing the same section immediately after such transfer has taken place.
Figure 2A:
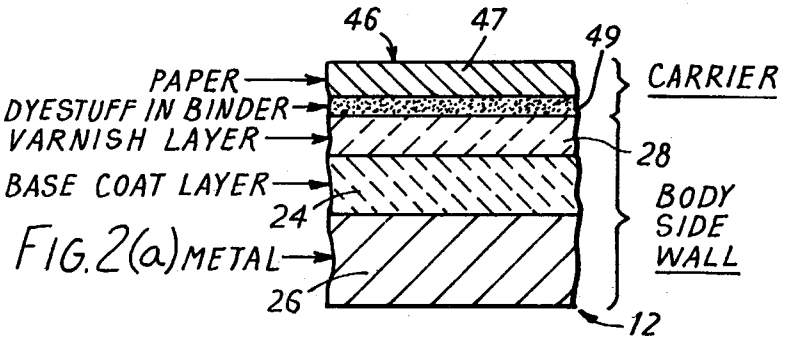

FIG. 2(*a*) shows a portion of the can body sidewall 26 with carrier applied to it, immediately prior to its entry into the oven 40. It will be noted that the dyestuffs are on the surface of the paper substrate 47 of the carrier, held in the binder layer 49 thereof. As the whole is heated, the paper substrate 47 shrinks due to loss of moisture, and being held by the adhesive to the can body, the carrier 46 thus becomes stretched into very intimate contact with the varnish layer 28, without the need for any additional mechanical pressure to be applied. At the same time, sublimation of the dyestuffs takes place so that the greater part of the dye is vaporised and diffuses into the varnish and base coat layers 28, 24 as generally illustrated by FIG. 2(*b*). Residual dyestuff remaining on the carrier is not needed for printing the can body.

Upon leaving the oven 40, the can bodies are allowed to cool so that the dyestuffs, and the indicia thereby transferred into the coating on the can body, become fast in the coating. The carriers are then stripped off by the stripper 42 and the can bodies are subsequently washed in the washer 44.

The adhesive in this example is of a water-soluble kind as has generally already been discussed. One suitable adhesive which is commercially available is of the earlier fully described so-called Dextrine Gum (Trade Mark) type, supplied by Williams Adhesives Ltd of Slough, Berkshire under the maker's reference number SW1934.

Figure 3:
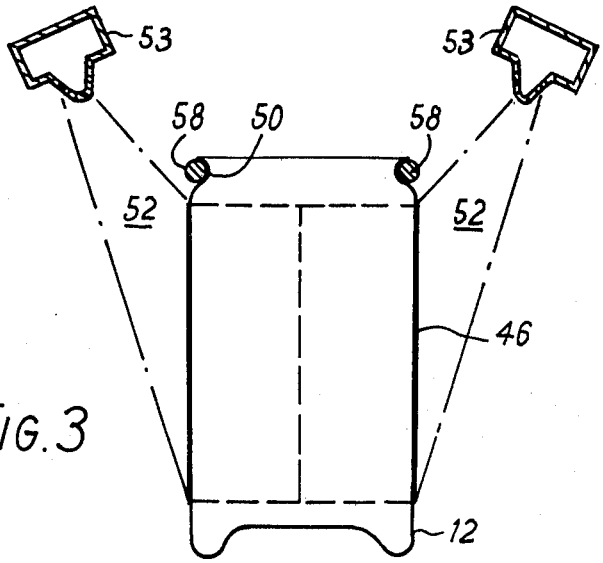
FIG. 3 is a simplified, cross-section taken on the line III—III in FIG. 4, to illustrate one method of removing the carrier from a metal can after the latter has received decoration.
Figure 4:
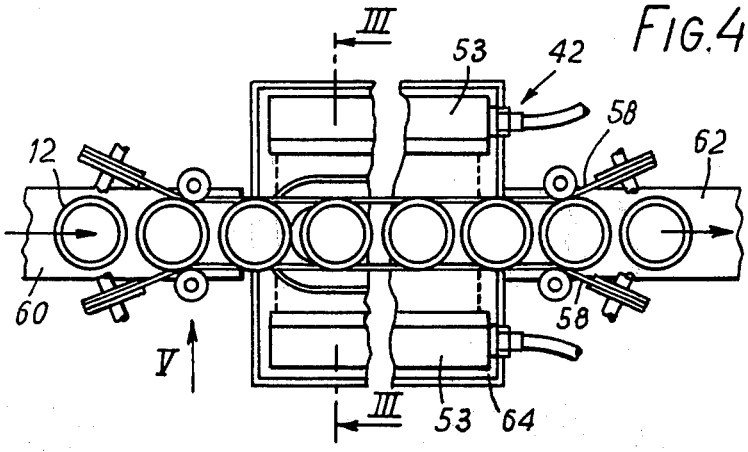
FIG. 4 is a simplified plan view of carrier-stripping apparatus for performing the stripping operation as shown in FIG. 3.
Figure 5:
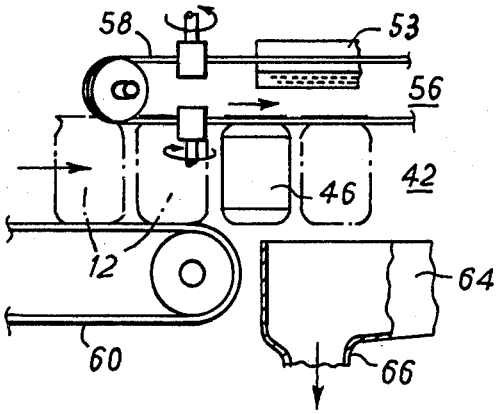
FIG. 5 is a partial elevation in the direction of the arrow V in FIG. 4.

Referring now to FIGS. 3 to 5, these Figures show one embodiment of the carrier stripper 42, in which the carrier 46 and the adhesive are stripped from the can body 12 by means of a water spray 52 delivered from a pair of parallel spray heads 53 located either side of a can body conveyor 56. The conveyor 56 is of the suspension type, in the form of a pair of endless bands 58 which engage within the end necks 50 of the can bodies 12 and support the latter by their end flanges. The bands 58 are driven (by means not shown) in synchronism with the conveyor 36, whose section upstream of the carrier stripper 42 for delivering can bodies to the latter, is indicated at 60. The bands 58 are arranged to pick each can body 12 in turn smoothly off the conveyor section 60 and to deliver it smoothly to a downstream section 62 of the conveyor 36. In operation, the water sprays dissolve the adhesive so that the carriers fall off, to be caught in a trough 64 and washed from there down a wide drain 66, preferably into a collecting zone from which the web paper can be removed in batches to a compacting device for squeezing out excess water and baling the resulting wet paper waste for subsequent pulping and re-use.

The stripping device 42 illustrated by FIGS. 4 to 5 is only one of many possible embodiments. In another version the can bodies may be urged along between a pair of moving elements which engage the carrier 46 frictionally so as to strip the latter from the can body, or to assist in such stripping whilst the can body is being drenched with the water sprays 52. Such moving elements will typically be of a rubbery material such as synthetic rubber, and may be arranged to move at different speeds in the forward direction, or one in the forward direction and one, at a slower speed, in the reverse direction.

A printing line such as that described above may typically be operated at a rate of about 800–1200 cans per minute. The provision of the can body washer 44 is optional if the carrier stripper 42 employs water sprays as described and is made such that the can bodies are satisfactorily clean upon reaching the conveyor section 62.

Similarly, the body preparation section 4 and carrier preparation section 2 need not be part of the same production line as the body printing section 6. If they are, however, either or both of the buffer stores 8, 10 may be absent, the appropriate section 2 or 4 being connected through a common conveyor system with the section 6 as indicated in FIG. 1 in broken lines.

If it is desired to vary the decoration between one can body and another, so as for example to produce can bodies all having a basic design but in which some feature of that design has a number of variations, the carrier 34, or a number of such carriers may be printed with the different designs and an automatic collator 68, FIG. 1, incorporated in the line for sorting into the required order the individual carriers 46 prior to their delivery to the carrier applicator 38.

We claim:

1. A method of decorating metal containers, including, in respect of each of a succession of metal containers, the steps (1) applying a separate, flexible carrier having an area substantially equal to the area to be decorated and printed with indicia in sublimable dyestuff over a coating receptive to such dyestuff on a surface of the container, temporarily holding the carrier on the container by means of an adhesive such as to be removable without damage to the coating;

(2) heating the container whilst the carrier is held to it, at such a temperature and for such a time that the carrier freely shrinks into intimate contact with the coating and a substantial proportion of the dyestuff sublimes so as to transfer the indicia into the coating;

(3) allowing the container to cool; and (4) stripping the carrier and adhesive.

2. A method according to claim 1 wherein the adhesive and carriers are applied by an automatic container-labelling machine.

3. A method according to claim 1, wherein the adhesive is applied to each successive container immediately prior to the presentation of the carrier thereto.

4. A method according to claim 2, wherein the adhesive is applied to each successive container immediately prior to the presentation of the carrier thereto.

5. A method according to claim 3, wherein the adhesive is applied in liquid form by way of a spray or jet of adhesive.

6. A method according to claim 4, wherein the adhesive is applied in liquid form by way of a spray or jet of adhesive.

7. A method according to claim 1, wherein the containers are heated by hot air.

8. A method according to claim 1, wherein the adhesive is water soluble.

9. A method according to claim 8, wherein the carrier and adhesive are stripped by the application of a water spray.

10. A method according to claim 1, wherein the containers are passed between a plurality of moving elements engaging the carrier so as to strip, or assist in stripping, the carrier and adhesive from the containers.

11. A method according to claim 10, wherein the moving elements comprise endless belts of rubbery material.

* * * * *